US007153154B2

(12) United States Patent
Ma et al.

(10) Patent No.: US 7,153,154 B2
(45) Date of Patent: Dec. 26, 2006

(54) ELECTRICAL CONNECTOR

(75) Inventors: Hao-Yun Ma, Tu-Chen (TW); Hua Yin Huang, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/946,183

(22) Filed: Sep. 20, 2004

(65) Prior Publication Data

US 2005/0064742 A1 Mar. 24, 2005

(30) Foreign Application Priority Data

Sep. 19, 2003 (TW) ..... 92216903 U

(51) Int. Cl.
*H01R 12/00* (2006.01)

(52) U.S. Cl. ..... 439/331; 439/73

(58) Field of Classification Search ..... 439/70, 439/71, 330, 331, 73
See application file for complete search history.

(56) References Cited

U.S. PATENT DOCUMENTS 4,601,525 A * 7/1986 Kandybowski ..... 439/329
4,621,884 A * 11/1986 Berkebile et al. ..... 439/367
RE32,370 E * 3/1987 Bright et al. ..... 439/71
5,302,853 A * 4/1994 Volz et al. ..... 257/707
5,588,847 A * 12/1996 Tate ..... 439/71
6,916,195 B1 * 7/2005 Byquist ..... 439/342

* cited by examiner

*Primary Examiner*—Thanh-Tam Le
(74) *Attorney, Agent, or Firm*—Wei Te Chung

(57) ABSTRACT

The electrical connector (1) includes a base having a number of terminals (12) thereon and a load plate (40) pivotally attached to a side of the base and locked in an opposite side of the base. The load plate (40) is stamped from a sheet of metal to form at least one pressing protrusion (43) to engagingly press an IC (60) in order to hold the IC (60) on the base. At least one pressing protrusion (43) has an outer edge (431) adjacent the IC (60) when the IC (60) is held on the base. The outer edge (431) is coined, thereby weeding out burrs formed on said outer edge (431) after the load plate (40) is stamped. As a result, the shape of the coined outer edge (431) of the pressing protrusion (43) can avoid scraping an IHS conglutinated on the IC (60) when the load plate (40) presses the IC (60), thereby to safely interconnect the IC (60) with the PCB.

10 Claims, 6 Drawing Sheets

ELECTRICAL CONNECTOR

BACKGROUND OF THE INVENTION

1. Field of the Invention

The present invention relates to the art of electrical connectors, and especially to an electrical connector for electrically interconnecting an integrated circuit (IC) with a printed circuit board (PCB).

2. Description of the Prior Art

Conventionally, an integrated heat spreader(IHS) is conglutinated on a bottom surface of an IC to avoid scraping the IC when a heat spreader is fixed on the IC and to prevent the destroy of the IC without a heat spreader. In use, the heat generated from the IC is transmitted to the IHS.

Referring to FIGS. 5 and 6, a typical electrical connector 8 for electrically interconnecting an IC 100 with a PCB comprises an dielectric housing 82, a plurality of terminals 81 received in the housing 82, a stiffener 83 surrounding the housing 82, a load plate 84 mounted on a side of the stiffener 83 and a load lever 85 mounted on an opposite side of the stiffener 83. Top ends of the terminals 81 are exposed above a top surface of the housing 82, for electrically connecting corresponding conductive members of the IC 100.

In assembly, the load plate 84 of the electrical connector 8 moves downwardly to press the IC 100 until the conductive members of the IC 100 elastically connect the terminals 81. The load plate 84 is made of metal. Because sharp burrs are formed on the edges of the load plate 84 during stamping the load plate 84 from a sheet of metal, it is prone to scrape the surface of the IHS when load plate 84 presses the IC 100. FIGS. 6 shows the destroyed surface of the IHS.

Accordingly, a new electrical connector that solves the above problems is desired.

SUMMARY OF THE INVENTION

An object of the present invention is to provide an electrical connector that can avoid scraping the IC, thereby safely interconnecting an IC with a PCB.

To fulfill the above object, an electrical connector is applied according to the present invention. The electrical connector comprises a base having a number of terminals thereon and a load plate pivotally attached to a side of the base and locked in an opposite side of the base. The load plate is stamped from a sheet of metal to form at least one pressing protrusion to engagingly press an IC in order to hold the IC on the base. At least one pressing protrusion has an outer edge adjacent the IC when the IC is held on the base. The outer edge is coined, thereby weeding out burrs formed on said outer edge after the load plate is stamped. As a result, the shape of the coined outer edge of the pressing protrusion can avoid scraping the IHS when the load plate presses the IC, thereby to safely interconnect the IC with the PCB.

Other objects, advantages and novel features of the present invention will become more apparent from the following detailed description when taken in conjunction with the accompanying drawings, in which:

DESCRIPTION OF PREFERRED EMBODIMENT OF THE INVENTION

Reference is now made to the drawings to describe the invention in detail.

Figure 1:
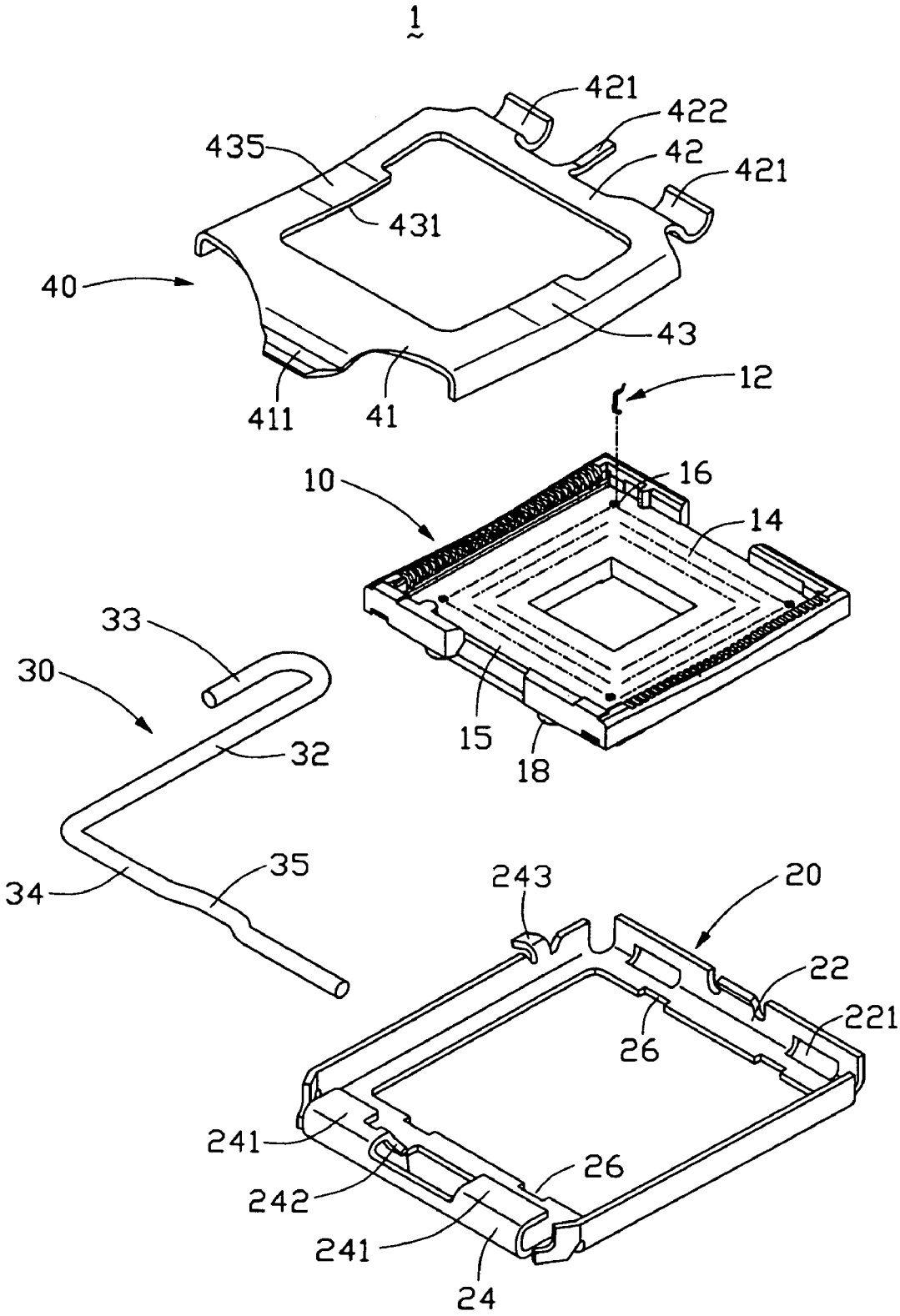
FIG. 1 is an exploded, isometric view of an electrical connector according to the present invention, the connector comprises a load plate.
Figure 2:
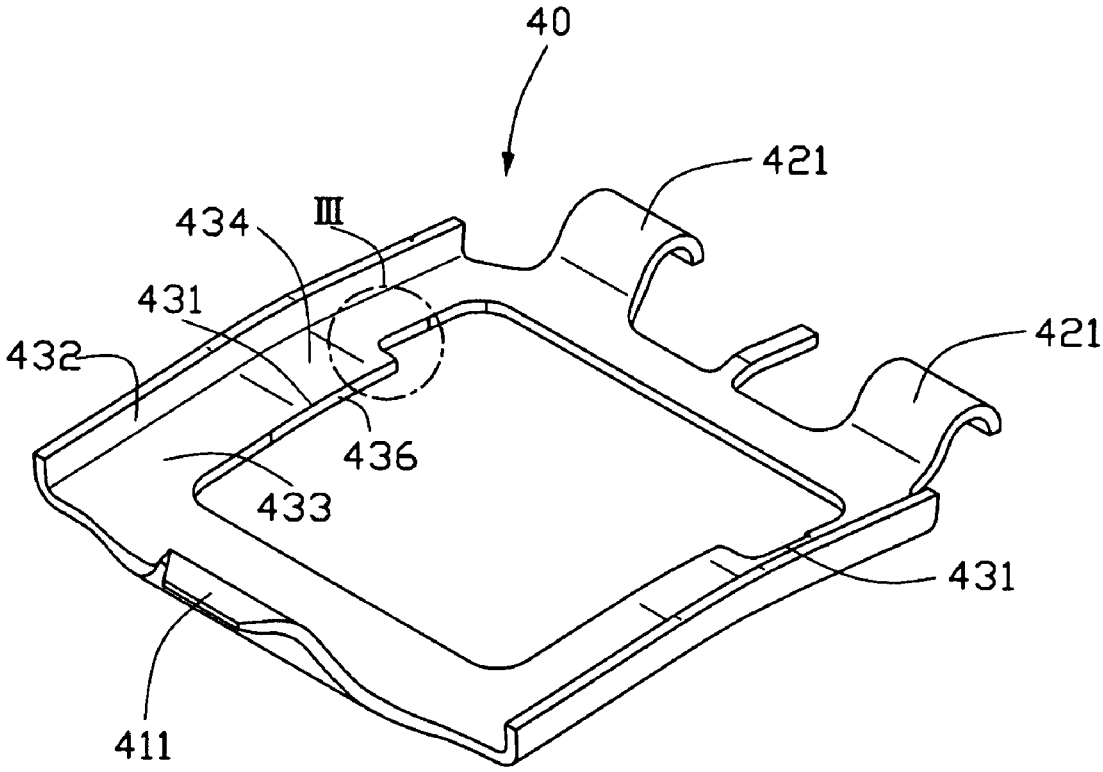
FIG. 2 is an isometric view of the load plate of FIG. 1, but showing from a reversed aspect.
Figure 3:
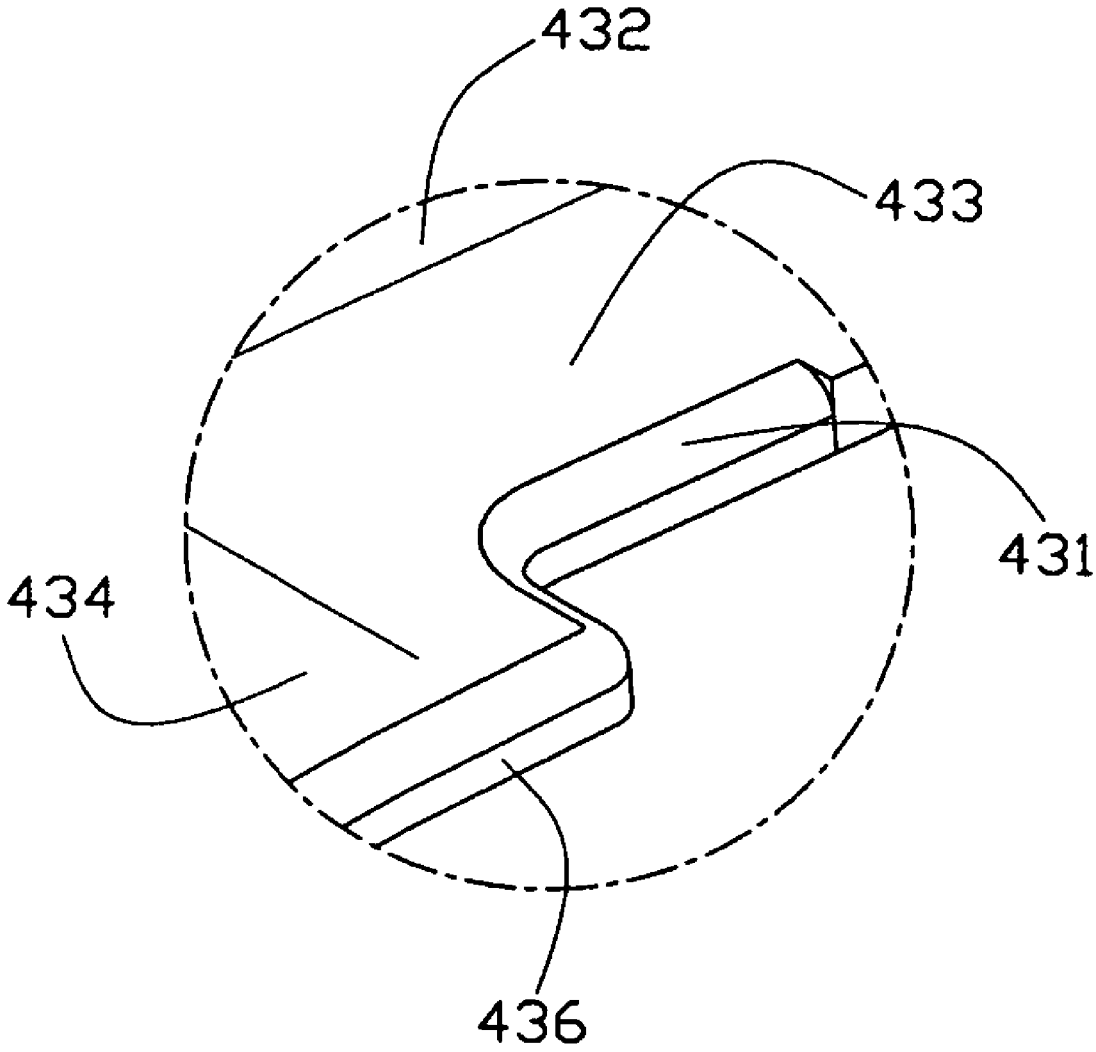
FIG. 3 is an enlarged view of a circled part III in FIG. 2.
Figure 4:
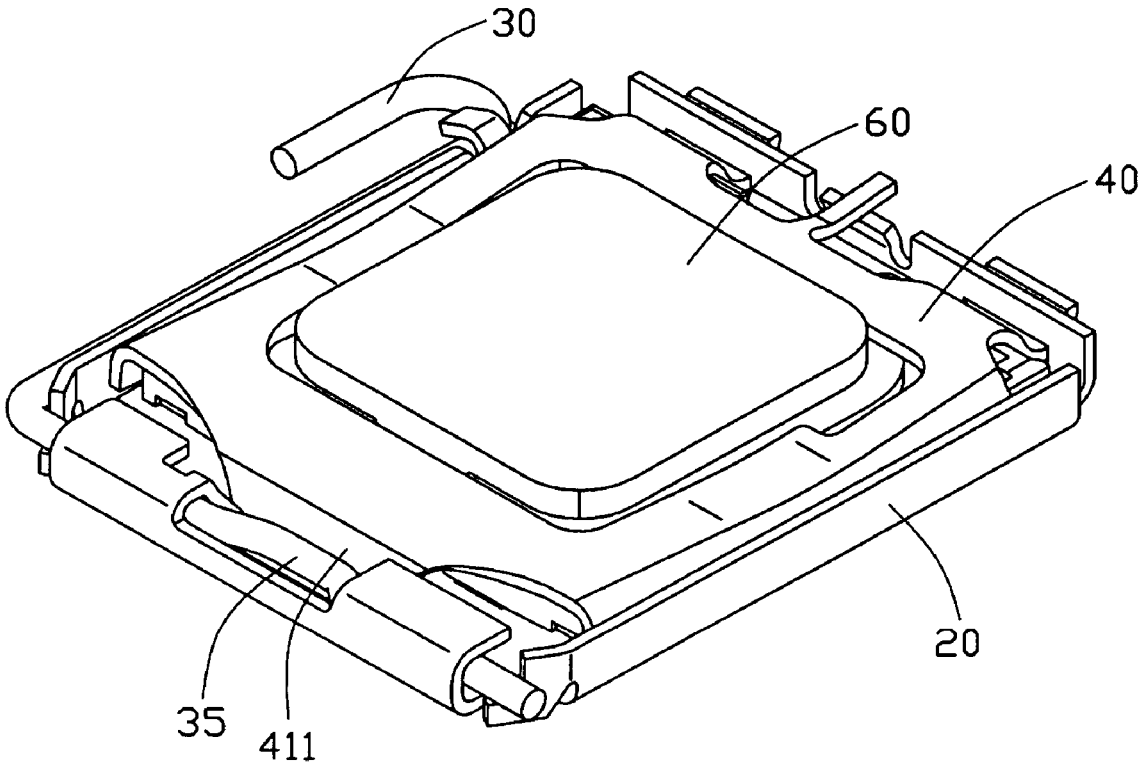
FIG. 4 is an isometric view of the electrical connector, with an IC positioned on the connector.
Figure 5:
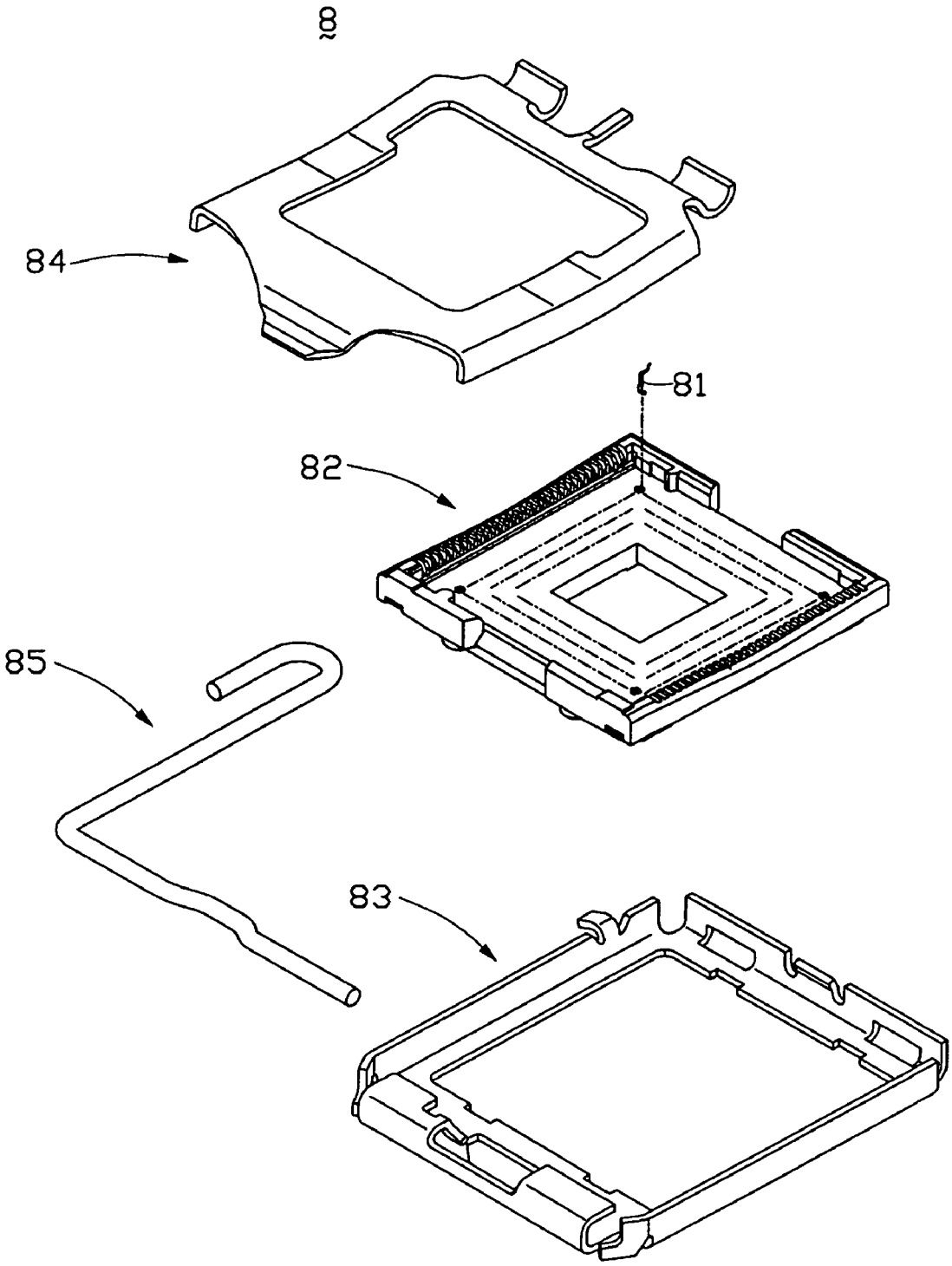
FIG. 5 (PRIOR ART)
FIG. 5 is an exploded, isometric view of a conventional electrical connector.
Figure 6:
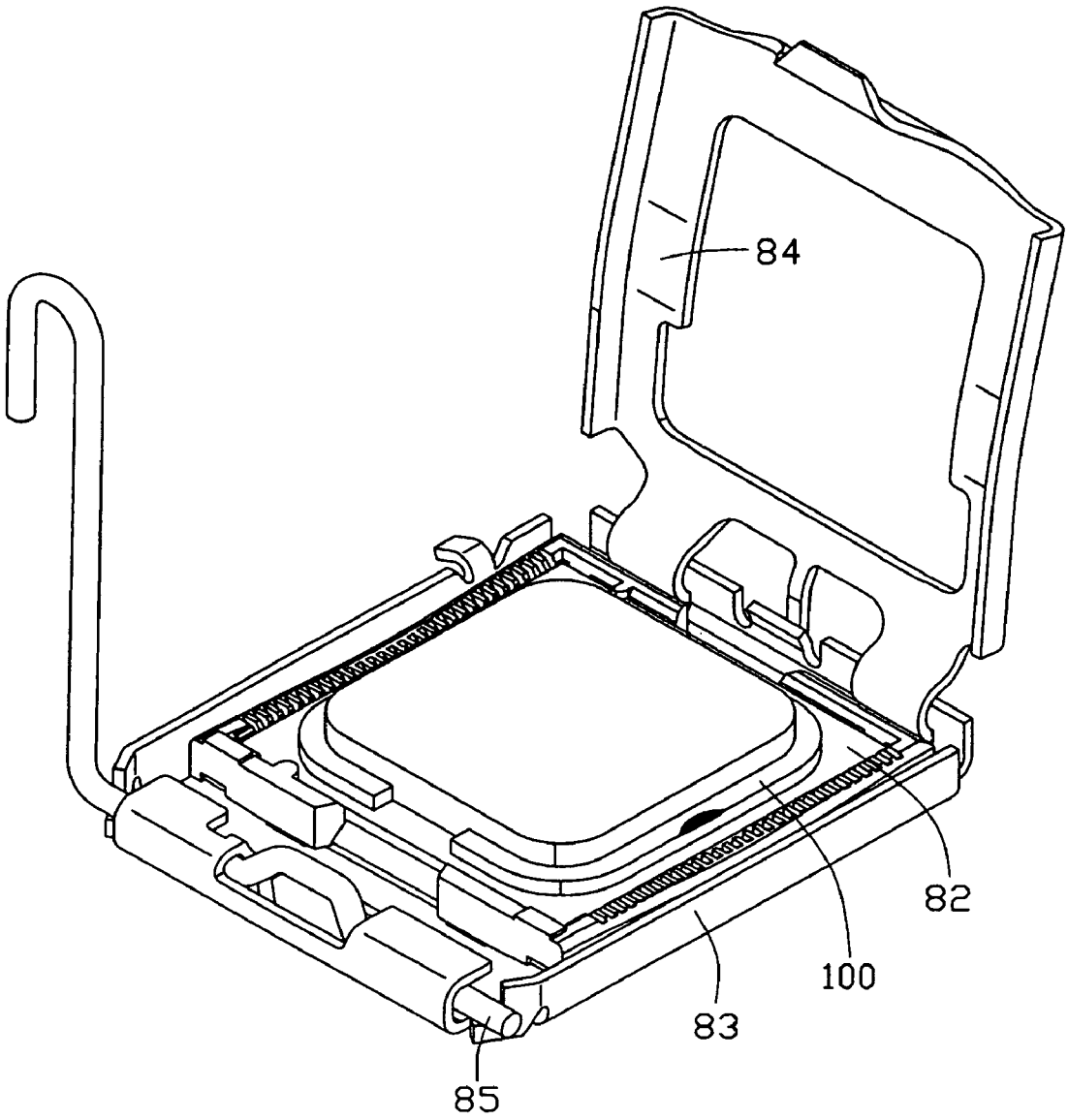
FIG. 6 (PRIOR ART)
FIG. 6 is an isometric view of an electrical connector in FIG. 4, together with an IC.

Referring to FIGS. 1, 2, 3 and 4, the electrical connector 1 applied according to the present invention is mainly used for electrically interconnecting an IC 60 with an electrical substrate such as a PCB (not shown). The electrical connector 1 comprises a base (not labeled), a load lever 30 mounted on one side of the base and a load plate 40 mounted on an opposite side of the base. The base comprises a dielectric housing 10 with a plurality of terminals 12 received thereof, and a stiffener 20 surrounding the housing 10.

The housing 10 has a flat board configuration with a rectangular conductive region 14 in the middle thereof. A contacting surface 15 is formed on the conductive region 14, for electrically supporting the IC 60. The conductive region 14 has a plurality of passageways 16 for receiving corresponding terminals 12. Contacting ends (not labeled) of the terminals 12 extend out of the contact surface 15 to resiliently contact corresponding conductive member (not shown) of the IC 60. The bottom surface of the housing 10 forms several positioning protrusions 18 thereof. The electrical connector 1 is electrically connected to the PCB and the IC 60 together, thereby the PCB and the IC 60 are electrically connected.

The load lever 30 is formed of a spindling metallic lever with several bent portions. The load lever 30 comprises an operational arm 32 and a pivot portion 34 extends perpendicularly from one end of the operational arm 32. The other end of the operational arm 32 has a handlebar 33 which generally parallel to the operational arm 32 for driving the load lever 30. The pivot portion 34 comprises a pair of pivot axels (not labeled) and a pressing portion 35 extending crookedly between the two pivot axels.

The load plate 40 is a rectangular frame with a space (not labeled) in the middle of it. The load plate 40 comprises a first sidewall 41 and a second sidewall 42 which opposite to each other. The sidewall perpendicular to the first sidewall 41 and the second sidewall 42 is two third sidewalls (not labeled). The third sidewall has a first plate 432 perpendicular to the stiffener 20 and a second plate 433 perpendicular to the first plate 432. A protruding portion 411 extends from the middle of the fist sidewall 41. A pair of C-shaped pivot latches 421 extends crookedly from the second sidewall 42. An operation bar 422 is formed on the second sidewall 42 between the two pivot latches 421. The middles of each second plates 433 of the third sidewalls protrude to the housing 21 to form a pressing protrusions 43, respectively. The pressing protrusion 43 comprises a bottom surface 434 facing to the IC 60 and a top surface 435 parallel to the bottom surface 434. A third surface 436 perpendicular to the bottom surface 434 is formed, the third surface 436 facing to the space of the load plate 40. The load plate 40 is stamped from a sheet of metal, such as steel. Several burrs are formed on the edges of the load plate 40 during stamping. The burrs will scrape an IHS conglutinated on the IC 60 when the IC 60 is mounted to the electrical connector 1. So after stamping, outer edges 431 of the pressing protrusions 43 are coined to weed out the burrs formed during stamping, and edges 431 with smooth surfaces and smooth edges are formed on the edges of the bottom surfaces 434 matching with the third surface 436 of the pressing protrusions 43. The edges 431 partly surround the IHS in assembly. In use, the bottom surface 434 of the pressing protrusions 43 of the load plate 40 touch the IC 60 and the edges 431 slide on the IHS until the pressing protrusions 43 is horizontal. Simultaneously, the pressing portion 35 of the load lever 30 presses the load plate 40 to achieve a sturdy connection between the conductive members of the IC 60 and the terminals 12 of the electrical connector 1.

The stiffener 20 which is a rectangular metallic frame. The stiffener 20 comprises a planar portion (not labeled) and four elongated sides (not labeled) perpendicularly and upwardly extending from outer side edges of the planar portion. The planar portion comprises a first side 22 abutting against the second sidewall 42 of the load plate 40 in assembly, a second side 24 opposite to the first side 22, and two third sides (not labeled) perpendicular to the first side 22 and the second side 24. The first side 22 defines a pair of pivot slots 221 corresponding to the pivot latches 421 of the load plate 40, facilitating the load plate 40 pivotally engaging with the stiffener 20. The second side 24 forms a pair of curve receiving groove 241. One of the receiving grooves 241 has a lock piece 242 for working cooperatively with the receiving groove 241 and ends of the two third sides to hold the load lever 30 in the second side 24 of the stiffener 20. One of the third sides has a protrusion 243 for locking the load lever 30. The planar portion from which the first side 22 and the second side 24 extend defines several positioning holes 26 corresponding to the positioning protrusions 18 of the housing 10.

In assembly, the load plate 40 is retained in the first side 22 of the stiffener 20, and the load lever 30 is received in the receiving groove 241 of the second side 24. Then the housing 10 is put into the stiffener 20. The positioning protrusions 18 on the bottom surface of the housing 10 is received in the corresponding positioning holes 26 of the stiffener to fix the housing 10 in the stiffener 20 which surrounds the housing 10.

In use, the load lever 30 pivots to the state perpendicular to the housing 10, and the pressing portion 35 of the load lever 30 is detached from the protruding portion 411 of the load plate 40. During assembly of the IC 60, the IC 60 is first received in the housing 10, the conductive members of the IC 60 corresponding to the terminals 12 received in the housing 10. The load plate 40 pivots downwardly to be horizontal, and the bottom surface 434 of the pressing protrusions 43 of the load plate 40 touch the IC 60 and the edges 431 slide on the IHS until the pressing protrusions 43 is horizontal. Simultaneously, the pressing portion 35 of the load lever 30 is forced by a outside force acting on the handlebar 33 to pivot to be horizontal and presses the protruding portion 411 of the load plate 40. The pressing protrusions 43 of the load plate 40 press the IC 60 to obtain a sturdy and reliable electrical connection of the conductive member of the IC 60 and the terminals 12 of the electrical connector 1. The operational arm 32 of the load lever 30 is retained under the protrusion 243 of the stiffener 20 to ensure the sturdy connection of the IC 60 on the electrical connector 1.

The smooth edges 431 on the bottom surface 434 of the pressing protrusions 43 edges weed out the burrs formed during stamping the load plate 40 scraping the IHS. Consequently, the edges 431 could protect the IHS and ensure a safe assembly process of the IC 60 and the electrical connector 1.

Furthermore, although the present invention has been described with reference to particular embodiment, it is not to be construed as being limited thereto. Various alterations and modifications can be made to the embodiment without in any way departing from the scope or spirit of the present invention as defined in the appended claims.

What is claimed is:

1. An electrical connector for electrically nesting an IC, the electrical connector comprising:

a base and a plurality of terminals on the base, the base being adapted for receiving the IC; and a load plate pivotally attached to a side of the base and locked in an opposite side of the base, the load plate being stamped from a sheet of metal to form at least one pressing protrusion to engagingly press the IC in order to hold the IC on the base;

wherein said at least one pressing protrusion has an outer edge adjacent the IC when the IC is held on the base, said outer edge being coined to weed out burrs formed on said outer edge after the load plate is stamped and to form a smooth surface to avoid scraping the IC;

wherein the at least one pressing protrusion comprises a bottom surface facing to the IC, a top surface parallel to the bottom surface, and a third surface perpendicular to the bottom surface, the third surface facing to a space of the load plate; and wherein the outer edge is formed on a boundary of the bottom surface matching with the third surface.

2. The electrical connector of claim 1, wherein the load plate comprises a first sidewall, a second sidewall opposite to the first sidewall, two opposite third sidewalls perpendicular to the first sidewall and the space surrounded by said sidewalls.

3. The electrical connector of claim 2, wherein each of the third sidewalls comprises a first plate and a second plate perpendicular to the first plate, and said at least one pressing protrusion is formed on the second plate.

4. The electrical connector of claim 3, wherein the pressing protrusion is formed on each of the third sidewalls integrally.

5. The electrical connector of claim 2, wherein the load plate comprises two pressing protrusions, two outer edges of the said pressing protrusions being symmetrical about the space of the load plate.

6. The electrical connector of claim 1, wherein the said base comprises a dielectric housing and a stiffener surrounding the housing, said housing receiving said terminals.

7. An electrical connector assembly comprising:

a base and a plurality of terminals on the base;

an IC received in the base; and a load plate pivotally attached to one end of the base and located on the IC, the load plate defining an opening with at least one pressing protrusion on a periphery of said opening and extending in both lengthwise and lateral directions with regard to the periphery to downwardly engagingly press the IC in order to hold the IC on the base when said load plate is in a locked position;

wherein said at least one pressing protrusion has an outer edge facing the opening, said outer edge being coined to form smooth surface to avoid scraping the IC;

wherein the at least one pressing protrusion comprises a bottom surface facing to the IC, a top surface parallel to the bottom surface, and a third surface perpendicular to the bottom surface, the third surface facing to a space of the load plate; and wherein the outer edge is formed on a boundary of the bottom surface matching with the third surface.

8. The assembly as claimed in claim 7, wherein said outer edge is coined toward said IC.

9. An electrical connector for use with an IC, comprising:

a base and a plurality of terminals on the base;

a metallic load plate made by stamping and pivotally attached to one end of the base, said load plate defining an opening with at least one pressing protrusion on a periphery of said opening and extending in both lengthwise and lateral directions with regard to the periphery to downwardly engagingly press the IC in order to hold the IC on the base when said load plate is in a locked position;

wherein said at least one pressing protrusion has an outer edge facing the opening, said outer edge being deformed to form thereon a downwardly curved smooth surface for remove any burrs formed thereon during said stamping so as not to scrap the IC when assembled;

wherein the at least one pressing protrusion comprises a bottom surface facing to the IC, a top surface parallel to the bottom surface, and a third surface perpendicular to the bottom surface, the third surface facing to a space of the load plate; and wherein the outer edge is formed on a boundary of the bottom surface matching with the third surface.

10. The connector as claimed in claim 9, wherein said downwardly curved smooth surface extends in both said lengthwise and lateral directions around a corresponding corner of said pressing protrusion.

* * * * *